US010119778B2

(12) United States Patent
Toups

(10) Patent No.: US 10,119,778 B2
(45) Date of Patent: Nov. 6, 2018

(54) SAFETY ACTUATOR FOR AK-47 FIREARMS

(71) Applicant: WAPENTEK, L.L.C., Poplarville, MS (US)

(72) Inventor: Thomas H Toups, Poplarville, MS (US)

(73) Assignee: WAPENKTEK, LLC, Poplarville, MS (US)

( * ) Notice: Subject to any disclaimer, the term of this patent is extended or adjusted under 35 U.S.C. 154(b) by 0 days.

(21) Appl. No.: 15/837,651

(22) Filed: Dec. 11, 2017

(65) Prior Publication Data

US 2018/0112941 A1 Apr. 26, 2018

Related U.S. Application Data

(63) Continuation of application No. PCT/US2016/037492, filed on Jun. 15, 2016, which
(Continued)

(51) Int. Cl.
*F41A 17/00* (2006.01)
*F41A 17/22* (2006.01)
(Continued)

(52) U.S. Cl.
CPC ..... *F41A 17/22* (2013.01); *F41A 19/46* (2013.01); *F41A 35/06* (2013.01); *F41A 11/02* (2013.01); *F41A 17/46* (2013.01)

(58) Field of Classification Search
CPC ..... F41A 17/00; F41A 17/20; F41A 17/22; F41A 17/24; F41A 17/26; F41A 17/28;
(Continued)

(56) References Cited

U.S. PATENT DOCUMENTS 2,453,683 A * 11/1948 Caldow ..... F41A 17/46 42/70.04
2,595,834 A * 5/1952 Fleenor ..... F41A 35/06 403/379.3
(Continued)

FOREIGN PATENT DOCUMENTS

DE 102009012771 B3 * 7/2010 ..... F41A 3/58

OTHER PUBLICATIONS

Dublin AK Bump Safety. <https://www.everydaynodaysoff.com/2011/05/24/ak-47-bump-safety/>. May 24, 2011. (Year: 2011).*
(Continued)

*Primary Examiner* — Gabriel J. Klein
(74) *Attorney, Agent, or Firm* — Roy Kiesel Ford Doody & Thurmon, APLC

(57) ABSTRACT

An improved safety actuator for an AK-47 firearm. The improved actuator utilizes a conventional receiver actuator modified to include a grip arm. The internal mechanism of the improved actuator and the conventional actuator are identical. This allows replacement of the conventional actuator with an improved actuator during field stripping, with no gun smithing. A grip arm depends from the receiver actuator, preferably from the receiver actuator's pivot point. The grip arm is aligned with the rifle's pistol grip. The shooter can control the safety actuator by squeezing the grip arm onto the pistol grip with his dominant hand. Thus, the safety may be moved from a safe position to a fire position without removing either hand from a sound firing position. The grip arm may be provided with a push bar to facilitate use of the dominant thumb to return the safety actuator to a safe position.

17 Claims, 6 Drawing Sheets

Related U.S. Application Data is a continuation-in-part of application No. 14/742,312, filed on Jun. 17, 2015.

(51) Int. Cl.

| | |
|---|---|
| ***F41A 35/06*** | (2006.01) |
| ***F41A 19/46*** | (2006.01) |
| *F41A 11/02* | (2006.01) |
| *F41A 17/46* | (2006.01) |

(58) Field of Classification Search

CPC ..... F41A 17/46; F41A 17/52; F41A 17/54; F41A 35/06

See application file for complete search history.

(56) References Cited

U.S. PATENT DOCUMENTS 2,711,043 A * 6/1955 Bent, Jr. ..... F41A 17/46 42/70.06

3,159,080 A * 12/1964 Freed ..... F41A 17/74 42/7

3,964,366 A * 6/1976 Atchisson ..... F41A 17/28 89/148

4,422,254 A * 12/1983 McQueen ..... F41A 17/56 42/70.05

4,763,431 A * 8/1988 Allan ..... F41A 17/04 42/66

5,517,780 A * 5/1996 Haber ..... F41A 17/20 42/70.01

OTHER PUBLICATIONS

Krebs Left Handed Safety. <http://www.akfiles.com/forums/showthread.php?t=191826>. Jul. 16, 2014. (Year: 2014).*

Safety Mod. <http://forum.saiga-12.com/index.php?/gallery/image/7732-imgp0248jpg/>. Nov. 10, 2012. (Year: 2012).*

* cited by examiner

PRIOR ART
7
24

Fig 2A
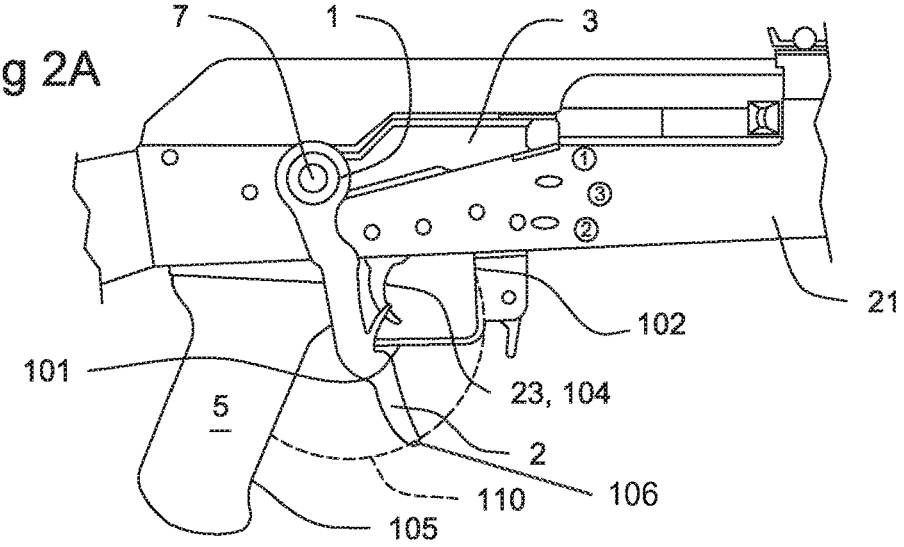
Fig 2B
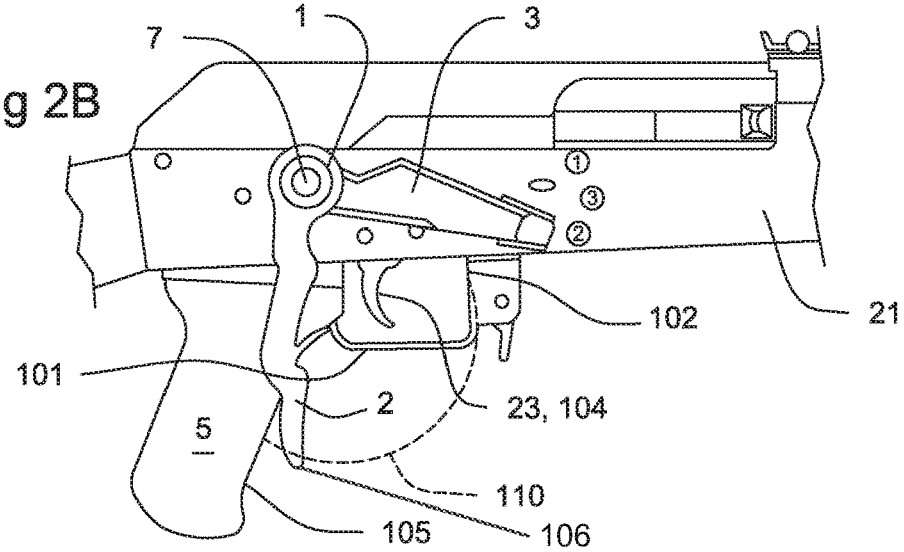
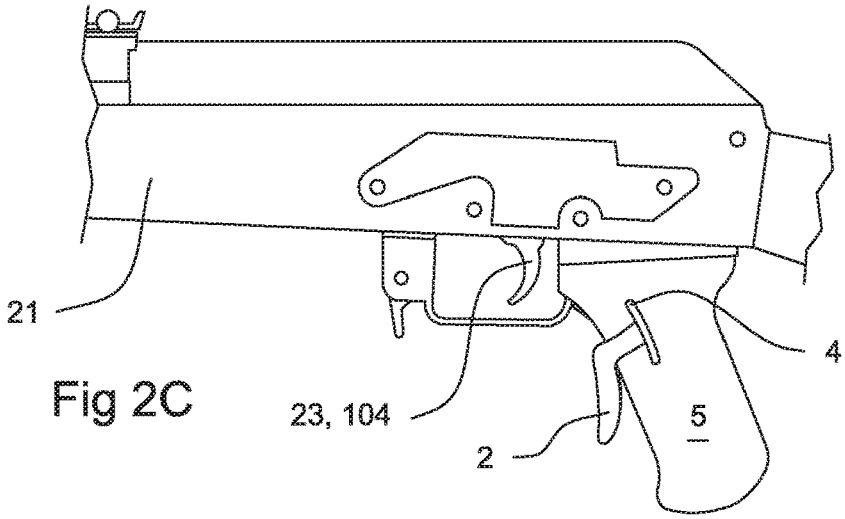
Fig 2C

SAFETY ACTUATOR FOR AK-47 FIREARMS

CONTINUATION HISTORY

This application is a continuation of International Application no. PCT/US2016/037492 (International Publication No. WO 2016/205275), which claims priority to U.S. patent application Ser. No. 14/742,312, both of which are incorporated by reference in their entirety.

BACKGROUND OF THE INVENTION

Field of the Invention

The invention relates to firearm safeties in general and safeties for Kalashnikov-style firearms in particular.

Prior Art

The AK-47 was created by a team of soviet weapon designers headed by former tank driver Mikhail Kalashnikov. There have been many iterations of the Russian version of the AK-47 over the years, but the majority of the design features were extant in the 1947 version of the rifle, hence the name.

The AK-47 was the principle service weapon of the Red Army for decades. During the Cold War it was exported extensively to Warsaw Pact countries. Numerous derivatives and outright copies were made by a host of manufacturers. The AK-47 and its variants have been manufactured in over twenty countries and used by the official forces of at least fifty. Professional forces ranging from the Israelis to the Finns have utilized AK-47's or variants. Revolutionary and guerilla forces have carried the weapon as well, from Mao's Communist revolutionaries to the Viet Cong to ISIS today. This class of rifles are commonly referred to as Kalashnikovs or AK-47's. Although most such weapons are, in fact, rifles, there are shotguns that embody the styling and mechanisms of the AK-47. The term AK-47 will be used herein to collectively refer to this entire class of firearms, including rifles and shotguns.

Over 100 million AK-47 rifles are believed to have been produced—an order of magnitude greater than any of its rivals. The AK-47 is, far and away, the most abundant firearm on the globe. The design is simple, reliable, and efficient. However, it has a long-standing problem: its safety and fire selector.

In the AK-47, the safety control is positioned on the right hand side of the rifle, immediately above and slightly forward of the trigger guard, as illustrated in FIG. 1A. Left handed shooters can operate the safety with their non-trigger (right) hand as illustrated in FIG. 1B. However, the weapon is not easy to fire when the left hand is in the position shown in FIG. 1B. To manipulate the safety in the manner shown in FIG. 1B, a left handed shooter must move his right hand to and from a firing position—typically the forearm of the weapon. Thus, when manipulating the safety, a left handed shooter's right hand is not in a good firing position on the weapon.

While there are problems enough for left-handed shooters operating the traditional AK-47 safety, the difficulties posed for the right handed are even greater. There are, of course, many more right-handed shooters than left-handed ones.

Right-handed shooters must either remove their right hand from the trigger area or reach over the top of the gun with their left to operate the safety. See, FIG. 1C. Both motions are awkward. This awkwardness can result in the weapon being carried in a non-safe/ready to fire position which, in turn, can result in accidental discharge and injury.

Conventional AK-47 safety selectors are also notoriously loud. The problem even has a name, "AK Clack." The sound of the weapon being moved from a safe to a ready to fire position can provide an enemy with a split second advance warning. Likewise, the sound can alert game to a hunter's presence. The desire to avoid creating this noise can cause a shooter to carry the weapon in a dangerous, ready to fire position.

There are, of course, other safety mechanisms known in the firearms field that could be utilized in AK-47 rifles. Most of these would require a factory-based alteration of the rifle design to produce a safety mechanism that could be conveniently controlled with the shooter's dominant hand. Such solutions are cold comfort to the users of the millions of AK-47 weapons already in circulation. Accordingly, an improved safety actuator for AK-47 rifles meeting the following objective is desired.

Objects of the Invention

It is an object of the invention to provide a safety actuator for an AK-47 rifle that may be operated with the shooter's dominant hand.

It is another object of the invention to provide a safety actuator for an AK-47 rifle that may be operated without removing either hand from sound shooting positions on the rifle.

It is still another object of the invention to provide a safety actuator for an AK-47 rifle that is interchangeable with conventional safety actuators without gun smithing or alteration of the weapon components.

It is yet another object of the invention to provide a safety actuator for an AK-47 rifle that provides a visual indication of the position of the rifle's safety/fire selector.

It is still another object of the invention to provide a safety actuator for an AK-47 rifle that provides a tactile indication of the position of the rifle's safety/fire selector detectable by the shooter's dominant hand with the dominant hand in a sound shooting position.

It is yet another object of the invention to provide a safety actuator for an AK-47 rifle that reduces noise relative to operation of a conventional AK-47 safety actuator.

It is still another object of the invention to provide a safety actuator for an AK-47 rifle that will be easy to operate and that will promote utilization of the safety by shooters.

SUMMARY OF THE INVENTION

An improved safety actuator for an AK-47 rifle is disclosed. The improved actuator utilizes a conventional receiver actuator modified to include a grip arm. The internal mechanism of the improved actuator and the conventional actuator are the same. This allows the conventional actuator to be removed during ordinary field stripping and be replaced with an improved actuator, with no need for gun smithing. In the improved actuator, a grip arm depends from the receiver actuator. The grip arm and the receiver actuator preferably connect at the pivot point of the receiver actuator, which connection may be releasable or permanent. The grip arm is configured to align with the pistol grip of the rifle. This allows the shooter to control the safety actuator by squeezing the grip arm onto the pistol grip with his dominant hand. Thus, the safety may be moved from a safe position to a fire position without the shooter removing either hand from a sound firing position. The grip arm may be provided with a push bar to facilitate use of the dominant thumb to return the safety actuator to a safe position, again without removing either hand from a sound firing position.

BRIEF DESCRIPTION OF THE DRAWINGS

FIG. 2A is an illustration of an AK-47 rifle having an embodiment of the improved safety actuator with the safety actuator in the safe position.

FIG. 2B is an illustration of an AK-47 rifle having an embodiment of the improved safety actuator with the safety actuator in a ready/fire position.

FIG. 2C is an opposite side view of the AK-47 rifle shown in FIG. 2B with an embodiment of the improved safety actuator in a ready/fire position.

DETAILED DESCRIPTION OF THE PREFERRED EMBODIMENT

Figures 1A, 6:
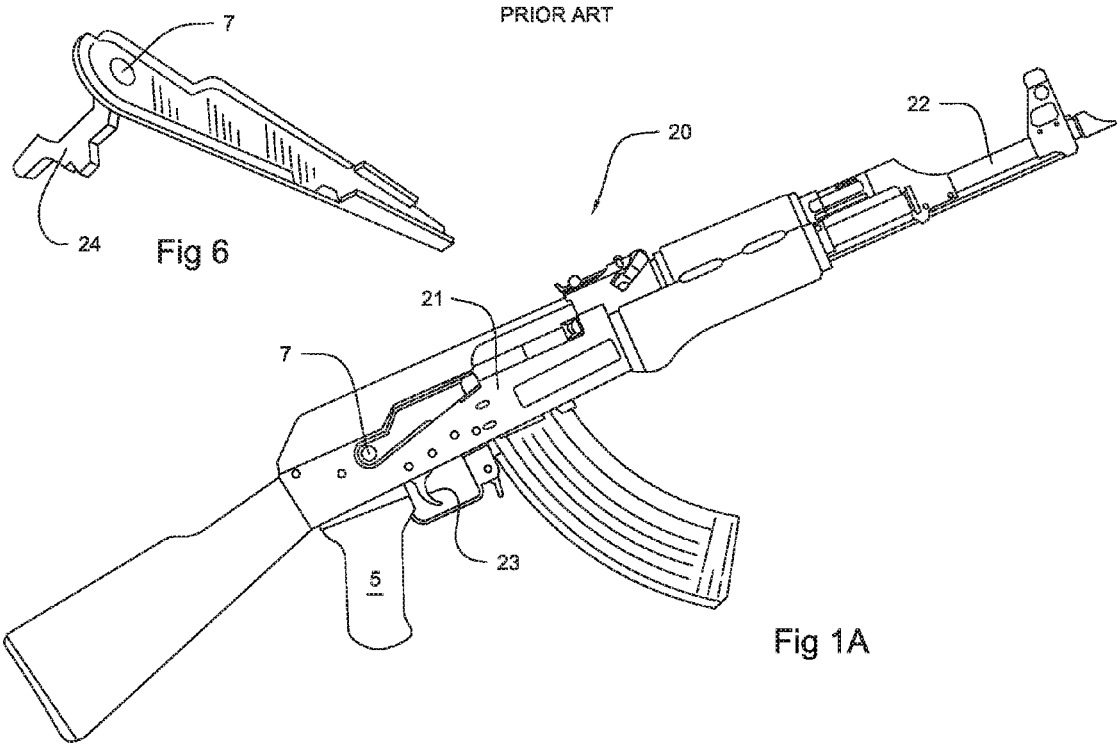
FIG. 1A is an illustration of an AK-47 rifle with a prior art safety actuator.
FIG. 6 is a perspective view of a prior art AK-47 safety actuator.
Figure 1B:
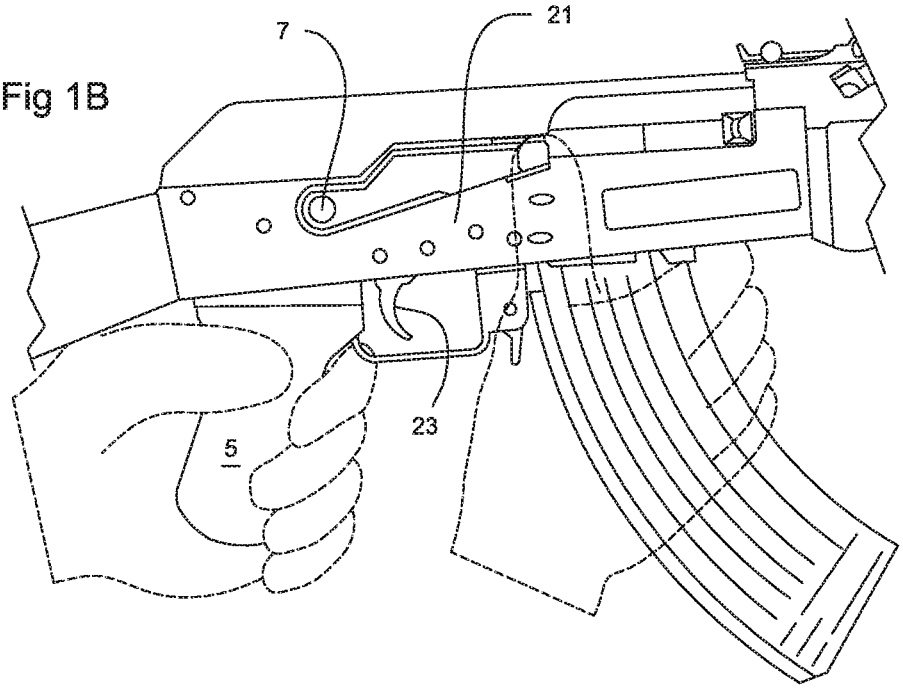
PRIOR ART Fig 1B
FIG. 1B is an illustration of the AK-47 rifle depicted in FIG. 1A in which the safety actuator is being operated by a left-handed shooter.
Figure 1C:
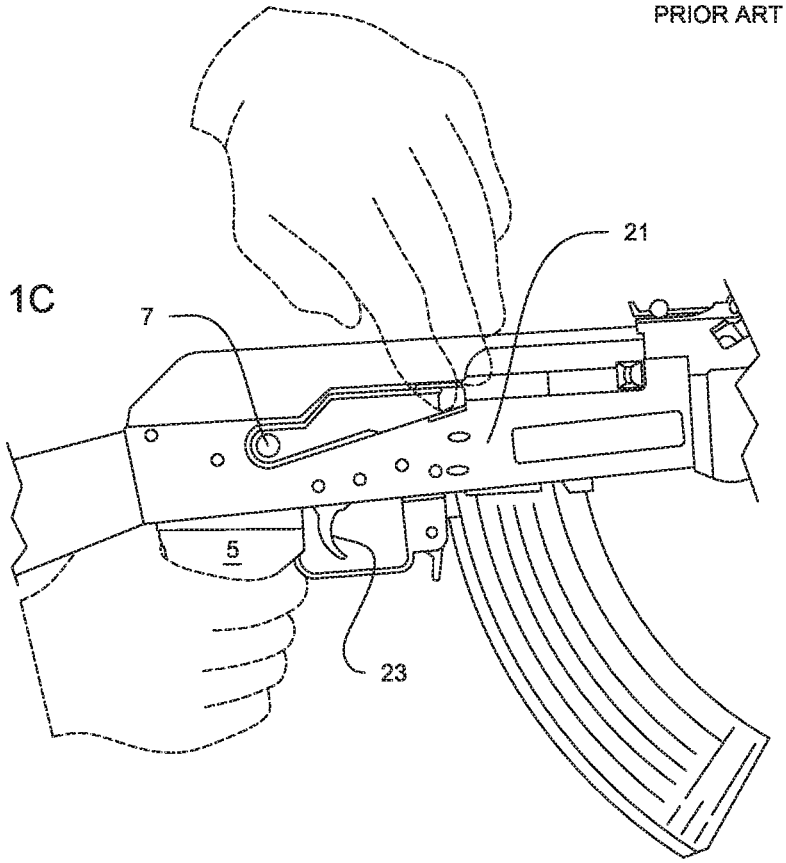
PRIOR ART Fig 1C
FIG. 1C is an illustration of the AK-47 rifle depicted in FIG. 1A in which the safety actuator is being operated by a right-handed shooter.

The invention pertains to a firearm 20, preferably an AK-47. The firearm comprises a receiver 21, a pistol grip 5 depending from receiver 21, a barrel 22 extending from receiver 21, a trigger mechanism 23 contained in receiver 21. Receiver 21 further comprises a safety mechanism 24 in operative engagement with trigger mechanism 23. The connection and operation of safety mechanism 24 and trigger mechanism 23 is well known in the art and is not disclosed in detail herein.

Pistol grip 5 has a leading edge 105. A trigger guard 101 depends from receiver 21. Trigger guard 101 has a leading edge 102 positioned forward of the trigger 104 and between trigger 104 and barrel 22.

The inventor has modified the standard safety actuator of an AK-47 to add a grip arm 2 that will allow the shooter to move the safety from the safe position to the fire position(s) by squeezing grip arm 2 with his firing (dominant) hand. FIG. 2A shows a weapon with the inventor's safety actuator 1 in the safe position. Grip arm 2 depends from the receiver actuator 3 at an approximate right angle. To move the weapon into the ready/fire position, the shooter need only squeeze the grip arm 2.

FIG. 2B shows the weapon in a ready/fire position. The grip arm 2 depending from the receiver actuator has been squeezed onto the pistol grip 5 of the weapon.

As illustrated in FIGS. 2A and 2B, grip arm 2 has a distal end 106 positioned across an arc 110 extending from leading edge 102 of trigger guard 101 to leading edge 105 of pistol grip 5. This will position grip arm 2 so that trigger guard 101 is between distal end 106 and receiver 21. Positioning grip arm 2 here will allow the shooter to reach grip arm 2 with the fingers of his dominant hand without removing his hand from pistol grip 5.

Figure 3A:
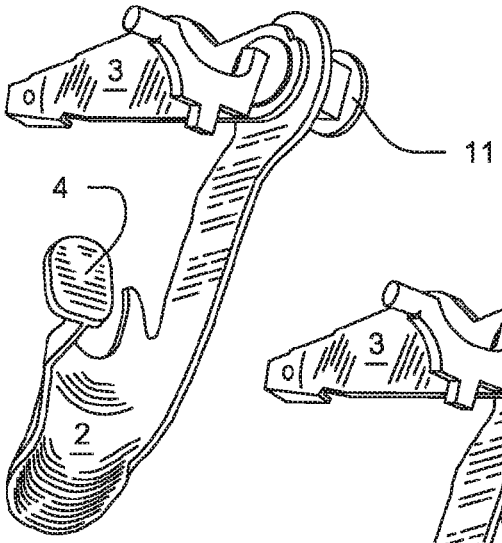
FIG. 3A is a perspective view of a right handed version of an embodiment of the improved safety actuator.
Figure 3B:
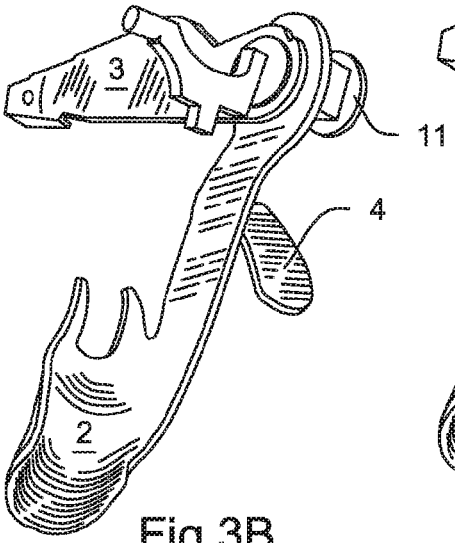
FIG. 3B is a perspective view of a left handed version of an embodiment of the improved safety actuator.

Grip arm 2 may be fitted with a push bar 4 that allows the shooter to return safety actuator 1 to the up/safe position by pushing on push bar 4 with his thumb. This can be done without releasing pistol grip 5. FIG. 2C shows the reverse side of the weapon with the safety actuator in the down/fire position. FIGS. 3A and 3B show alternative versions of safety actuator 1 in which arm 2 is fitted with push bar 4 on the left and right sides, respectively. Positioning push bar 4 on the right side of grip arm 2 will allow a left handed shooter to utilize improved safety actuator 1 with his trigger hand. FIG. 3C illustrates a grip arm 2 embodying ambidextrous push bars 4. In any of the foregoing embodiments, the user may use the thumb of his trigger hand to return the rifle to a safe position, simply by pushing on push bar 4.

Figure 3D:
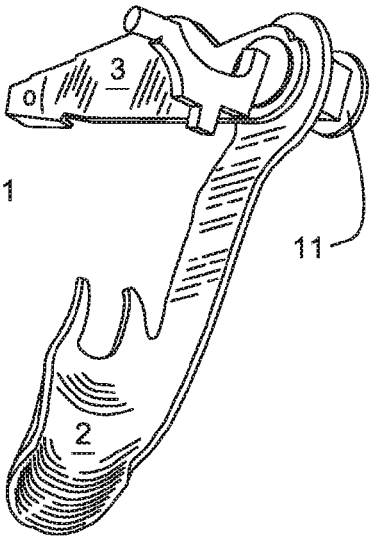
FIG. 3D is a perspective view of another ambidextrous embodiment of the improved safety actuator.
Figure 3C:
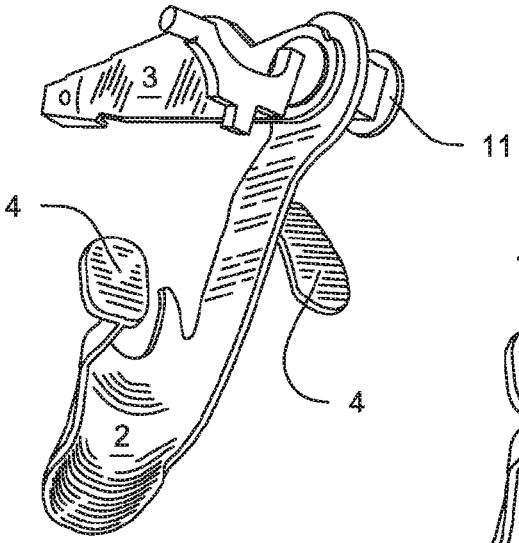
FIG. 3C is a perspective view of an ambidextrous embodiment of the improved safety actuator.
Figure 4:
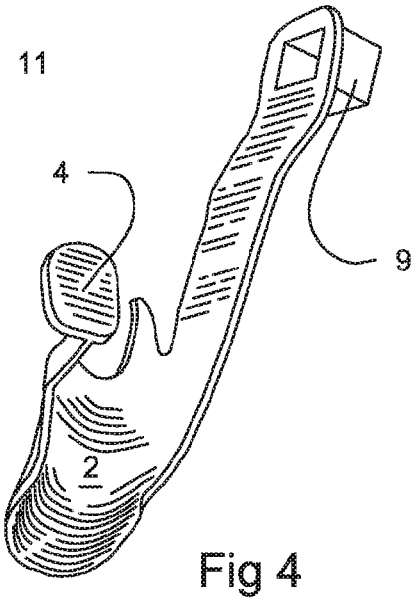
FIG. 4 is a perspective view of the receiver arm of an embodiment of the improved safety actuator.

Another ambidextrous option is illustrated in FIG. 3D. This version includes no push bar 4 on grip arm 2. In this embodiment, the shooter would return safety actuator 1 to a safe position by placing one or more fingers between pistol grip 5 and grip arm 2 and pushing grip arm 2 forward by extending his fingers away from pistol grip 5 or by manipulating receiver actuator 3 in conventional fashion.

Figure 5:
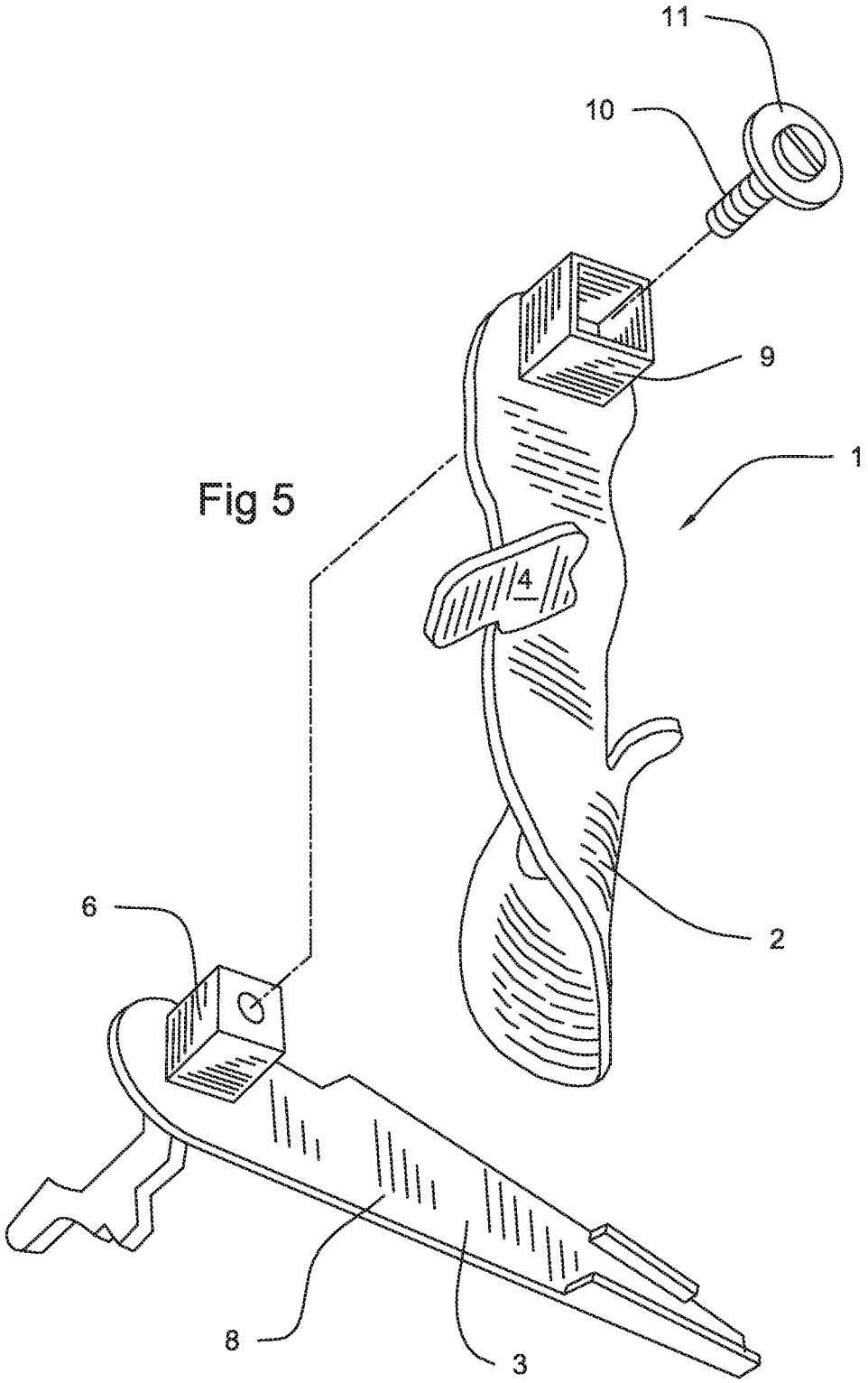
FIG. 5 is an exploded view of an embodiment of the improved safety actuator.

A significant advantage of the invention is that existing AK-47 rifles may be easily retrofitted to accept improved safety actuator 1. FIG. 6 illustrates a conventional AK-47 safety actuator. As can be seen in FIG. 5, an embodiment of the invention includes a conventional AK-47 safety actuator modified by the addition of a piece of square stock 6 to its pivot point 7 on the outward facing side 8 of the actuator. In this embodiment, grip arm 2 is provided with a piece of square tubing 9 sized to receive square stock 6, thereby allowing grip arm 2 to mate with the modified conventional safety actuator. By internally threading square stock 6, the two pieces may be joined using a threaded bolt 10 having a head 11 sized to preclude removal of grip arm 2 from the threaded square stock 6 while bolt 10 is in place. While FIG. 5 illustrates the two pieces 2, 3 of improved safety actuator 1 being joined with a threaded fastener 10, it will be appreciated that any conventional means of joining the components could be utilized. Likewise, while square stock 6 and square tubing 9 were utilized in the embodiment depicted herein, the means of joining the components of safety actuator 1 is not material. Any conventional joining means or mechanism could be used.

Additionally, a two piece actuator 1 may facilitate installation. However, there is no reason why improved safety actuator 1 could not be made of a single piece if the components were properly sized. Similarly, receiver actuator 3 and grip arm 2 could be made of more than two pieces if desired.

As will be appreciated from a comparison of FIG. 6 with FIGS. 3A-3D, improved actuator 1 may be easily substituted for a factory actuator. The weapon may be field stripped in precisely the same manner as it would for ordinary cleaning. The factory safety actuator may be removed and an improved actuator 1, such as the ones shown in FIG. 3A-3D, installed in its place. The portions of improved actuator 1 interior to the rifle function in precisely the same manner as the factory actuator. No gun smithing will be required to make improved actuator 1 function with the safety mechanism of the rifle. No tools are required to substitute improved actuator 1 for a conventional actuator, though a screw-driver or a wrench may be useful to tighten the connection between the components 2, 3 in the embodiment shown in FIG. 5. Anyone capable of field stripping an AK-47 should be able to substitute improved actuator 1 for the existing safety selector in a conventional AK-47. Improved actuator 1 may require minor dimensional alterations to work with some variants, but the basic design will work with a host of AK-47 models.

Neither the rifle's receiver nor any of its other parts need to be modified for improved actuator 1 to be used. Improved actuator 1 will not alter the cyclic rate or any of the firing characteristics of the rifle.

Pistol grip 5 in most AK-47 models is about 9/10ths of an inch thick and positioned at about a 70 degree angle relative to the receiver. By following these dimensions, improved actuator 1 may be configured to prevent actuator 1 from being removed or installed unless the safety is in the safe position. This will prevent operators from removing or installing the actuator while the weapon is in a ready to fire position.

Some firearms are provided with thumb holes in the stocks. Examples include U.S. Pat. D648,412 and Published U.S. Patent Application Pub. No. US 2005/0235546, both of which are hereby incorporated by reference in their entirety. In a thumb hole stock, a passage is provided in the stock behind the grip. This allows the shooter to hold the grip of the stock by passing his thumb, and in many cases a greater or lesser amount of his palm, through the passage. A weapon equipped with a thumb hole stock may be held in substantially the same manner as a stock equipped with a pistol grip. This is so, even though the grip is connected to the remainder of the stock at both ends of the grip, whereas in a traditional pistol grip, the grip is only attached to the stock at one end of the grip. The term "pistol grip" as used herein is intended to encompass both free pistol grips, that is grips that are only attached to the stock at one of the grip, and thumb hole stocks in which the grip is attached to the stock at two ends.

In the preferred embodiment, grip arm 2 is attached to the modified receiver actuator 3 and simultaneously positioned over pistol grip 5. In this position, the user may operate the safety with only his trigger hand. This will facilitate one handed firing of the weapon in the event the shooter is injured.

It will be appreciated that improved safety actuator 1 could effectively omit the elongated receiver actuator 3—the lever positioned over the trigger—and still function. Grip arm 2 could depend from an abbreviated receiver actuator 3 consisting essentially of pivot point 7. However, in the preferred embodiment, elongated receiver actuator 3 is retained for several reason. First, keeping elongated receiver actuator 3 offers a useful redundancy. The shooter may have trained on a rifle without improved safety actuator 1. In a crisis, the shooter could attempt to operate the safety in the manner in which he was originally trained. Retaining elongated receiver actuator 3 will ensure that such a user will be able to operate the safety without having to remember the difference between improved actuator 1 and the actuator on which he was trained. Similarly, should grip arm 2 become broken, the safety could still be operated using elongated receiver actuator 3. Second, elongated receiver actuator 3 provides a visual indicator of whether the weapon is in safe or a ready to fire condition. Maintaining elongated receiver actuator 3 continues this visual indicator. There is nothing to relearn, though it is observed that grip arm 2 will also provide a visual indicator that will be apparent from either side of the weapon. Third, the standard AK-47 actuator and receiver are provided with a set of detents that holds the safety actuator/selector in its various positions. Retaining elongated receiver actuator 3 allows for continued use of the factory detent system.

The detents are different for fully automatic, military and semi-automatic, civilian versions of the AK-47. In fully automatic versions, the safety actuator/selector has three positions: fully up/first position is safe; fully down/second position is semi-automatic fire (single shot per trigger pull); and the third/middle position is fully automatic fire. In civilian versions, the safety actuator/selector has only two positions: fully up/first position is safe and fully down/second position is semi-automatic fire. When improved actuator 1 is in the safe position, safety mechanism 24 will prevent trigger mechanism 23 from functioning. Improved actuator 1 can be used with the safety actuators on military and civilian versions of the AK-47 alike.

Some AK's have a fourth safety actuator/selector position that allows for "burst" operation of the weapon, during which several rounds are fired with a single pull of the trigger, but wherein the weapon will not continue to fire indefinitely. Improved safety actuator 1 could be used with AK's with four selector settings, or any number of selector settings for that matter, in the same manner described above.

Improved actuator 1 will provide a tactile indication of safety position. The shooter can tell the position of the safety selector by feel. Significantly, this can be done using the dominant hand without removing that hand from the trigger area. This will facilitate determination of firing/safety selector position in darkness.

In the preferred embodiment, improved actuator 1 is made of carbon or stainless steel using conventional metal fabrication techniques such as stamping, welding, or casting. However, other conventional firearm materials and fabrication techniques may be utilized as desired. The added mass of grip arm 2 will dampen the motion of receiver actuator 3. This will reduce the noise associated with movement of receiver actuator 3, the so-called AK Clack.

In operation, the shooter will squeeze grip arm 2 of safety actuator 1 toward leading edge 105 of pistol grip 5 of the rifle to move safety actuator 1 from the safe position into a fire position. In a fully automatic AK, the shooter will stop squeezing grip arm 2 when the third/middle position is reached if fully automatic operation is desired. If the shooter wishes to switch to semi-automatic operation of the rifle, the shooter will continue squeezing grip arm 2 until the second/bottom position is reached. The shooter may move from the second/bottom position to the fully automatic third position by applying forward pressure (away from pistol grip 5) to push bar 4 with his thumb or to grip arm 2 with any digit(s). Similarly, the shooter may move the safety actuator into the safe position by continuing to apply forward pressure to push bar 4 or directly to grip arm 2. Operation of improved safety actuator 1 in a semi-automatic AK is similar. The user will squeeze grip arm 2 toward pistol grip 5 to move safety actuator 1 from the first/safe position to the second/bottom position—the only fire position in semi-automatic versions. To return safety actuator 1 to the safe/fully up first position, the shooter will apply pressure to push bar 4 or directly to grip arm 2.

These and other improvements to the safety actuator of an AK-47 rifle will be apparent to those of skill in the art from the foregoing disclosure and drawings and are intended to be encompassed by the scope and spirit of the following claims.

The invention claimed is:

1. An improved safety actuator for a firearm, wherein the firearm comprises a receiver, a barrel extending from said receiver, a pistol grip depending relative to said receiver, said pistol grip having a leading surface facing said barrel, a trigger mechanism contained in said receiver, a trigger guard depending from said receiver, said trigger guard having a leading edge positioned between said pistol grip and said barrel, and a safety mechanism positioned in said receiver and in operative engagement with said trigger mechanism, said safety mechanism having a safe position in which the trigger mechanism cannot be operated and at least one fire position in which the trigger mechanism can be operated, said safety mechanism further comprising a receiver actuator positioned on the exterior of the receiver and configured to move said safety mechanism between said safe position and said at least one fire position upon the application of force to said actuator, wherein the improved safety actuator comprises:

a grip arm depending from and in mechanical communication with said receiver actuator, said grip arm having a distal end, said grip arm extending relative to said trigger guard so that the entirety of said trigger guard is between said distal end and said receiver, wherein said grip arm is further positioned across an arc whose ends are defined by said leading edge of said trigger guard and said leading surface of said pistol grip, whereby an application of force to said grip arm toward said leading edge of said pistol grip will apply force to said receiver actuator and cause said safety mechanism to move along said arc from said safe position to said at least one fire position.

2. An improved safety actuator according to claim 1 further comprising a push bar extending substantially perpendicularly from said grip arm, whereby force may be applied to said grip arm in a direction away from said pistol grip by pushing on said push bar, thereby causing said safety mechanism to move from said at least one fire position to said safe position.

3. An improved safety actuator according to claim 1 wherein the firearm is an AK-47.

4. An improved safety actuator according to claim 3 wherein said safety actuator is configured to be operated by a shooter having a dominant hand.

5. An improved safety actuator according to claim 4 wherein said safety actuator is configured to be operated with said dominant hand of said shooter.

6. An improved safety actuator according to claim 5 wherein said safety actuator is configured to be operated with said dominant hand gripping said pistol grip of said firearm.

7. An improved safety actuator according to claim 3 wherein said safety actuator is configured to be installed without the use of tools.

8. An improved safety actuator according to claim 1 wherein said receiver actuator is elongated.

9. An improved safety actuator according to claim 8 wherein said receiver actuator has a pivot point.

10. An improved safety actuator according to claim 9 wherein said grip arm depends from said receiver actuator at about said pivot point.

11. An improved safety actuator according to claim 10 wherein said grip arm is configured to dampen vibrations in said receiver actuator.

12. An improved safety actuator according to claim 1 wherein said safety actuator is configured to provide a visual indication from either side of said firearm of whether said firearm is in said safe position.

13. An improved safety actuator for an AK-47 pattern firearm, wherein the AK-47 pattern firearm comprises a receiver, a barrel extending from said receiver, a pistol grip depending relative to said receiver, said pistol grip having a leading surface facing said barrel, a trigger mechanism contained in said receiver, a trigger guard depending from said receiver, said trigger guard having a leading edge positioned between said pistol grip and said barrel, and a safety mechanism positioned in said receiver and in operative engagement with said trigger mechanism, said safety mechanism having a safe position in which the trigger mechanism cannot be operated and at least one fire position in which the trigger mechanism can be operated, wherein the improved safety actuator comprises:

a grip arm depending from and in mechanical communication with said safety mechanism, said grip arm having a distal end, said grip arm extending relative to said trigger guard so that the entirety of said trigger guard is between said distal end and said receiver, wherein said grip arm is further positioned across an arc whose ends are defined by said leading edge of said trigger guard and said leading surface of said pistol grip, whereby an application of force to said grip arm toward said leading edge of said pistol grip will apply force to said safety mechanism and cause said safety mechanism to move along said arc from said safe position to said at least one fire position.

14. An improved safety actuator according to claim 13 further comprising a push bar extending substantially perpendicularly from said grip arm, whereby force may be applied to said grip arm in a direction away from said pistol grip by pushing on said push bar, thereby causing said safety mechanism to move from said at least one fire position to said safe position.

15. An improved safety actuator according to claim 13 wherein said safety actuator is configured to be operated by a shooter having a dominant hand.

16. An improved safety actuator according to claim 15 wherein said safety actuator is configured to be operated with said dominant hand of said shooter.

17. An improved safety actuator according to claim 16 wherein said safety actuator is configured to be operated with said dominant hand gripping said pistol grip of said AK-47 pattern firearm.

* * * * *